US006584699B2

(12) United States Patent
Ronning et al.

(10) Patent No.: US 6,584,699 B2
(45) Date of Patent: Jul. 1, 2003

(54) THREE STAGE SINGLE PASS HIGH DENSITY DRYING APPARATUS FOR PARTICULATE MATERIALS

(75) Inventors: Richard L. Ronning, Overland Park, KS (US); Robert Kolb, Olathe, KS (US)

(73) Assignee: Ronning Engineering, Co., Inc., Overland Park, KS (US)

( * ) Notice: Subject to any disclaimer, the term of this patent is extended or adjusted under 35 U.S.C. 154(b) by 12 days.

(21) Appl. No.: 09/858,013

(22) Filed: May 15, 2001

(65) Prior Publication Data

US 2002/0184787 A1 Dec. 12, 2002

(51) Int. Cl.[7] ..... F26B 11/02

(52) U.S. Cl. ..... 34/134; 34/318; 34/63; 34/108; 34/109; 34/115; 34/602; 34/604; 34/135

(58) Field of Search ..... 34/318, 370, 427, 34/443, 451, 514, 520, 63, 90, 108, 109, 113, 114, 115, 595, 602, 603, 604, 134, 135, 136, 137, 139, 140, 141, 142, 166

(56) References Cited

U.S. PATENT DOCUMENTS 2,470,315 A * 5/1949 McGehee ..... 241/54
2,506,739 A * 5/1950 Raypholtz ..... 259/3
2,578,166 A * 12/1951 Bill ..... 34/136
2,810,968 A * 10/1957 Pitt ..... 34/109
4,177,575 A * 12/1979 Brooks ..... 34/13
4,612,711 A * 9/1986 Murray ..... 34/39
4,633,595 A * 1/1987 van den Broek ..... 34/108
5,421,528 A * 6/1995 Running ..... 241/57
6,119,363 A * 9/2000 Bahner et al. ..... 34/135

* cited by examiner

*Primary Examiner*—Ira S. Lazarus
*Assistant Examiner*—K. B. Rinehart
(74) *Attorney, Agent, or Firm*—Hovey Williams LLP

(57) ABSTRACT

A single pass, multiple stage, rotary drum heat exchange dryer (22) is provided for drying products such as distillers grains and includes a tubular shell (64) with a moist product inlet (66), an opposed dried product outlet (70), and an internal drying chamber (78). The chamber (78) includes a convection drying first stage (80), and conductive drying final curing stage (82) an intermediate stage (84); the stage (84) is subdivided into a plurality of preferably contiguous drying zones (86–92). The zones (86–92) include individual flighting assemblies (164, 214, 226, 234) which are of increasing density and present progressively increasing heat transfer ratios. Preferably, one of the initial zones has a heat transfer ratio of from about 1.5–2.5 $ft^{-1}$, whereas another of the zones closer to the final stage has a heat transfer of from about 2.75–3.75 $ft^{-1}$.

12 Claims, 7 Drawing Sheets

THREE STAGE SINGLE PASS HIGH DENSITY DRYING APPARATUS FOR PARTICULATE MATERIALS

BACKGROUND OF THE INVENTION

1. Field of the Invention

The present invention is broadly concerned with high density, multiple stage, single pass rotary drum dryers especially useful for the high-efficiency drying of moisture-laden products. More particularly, the invention is concerned with such dryers which include an initial, primarily convection drying stage, a final, primarily conductive drying stage, and an intermediate multiple-zone stage where both convective and conductive drying occurs; the individual zones within the intermediate stage are equipped with internal flighting designed so that the heat transfer ratio (the total zone heat transferring surface area divided by the zone volume) progressively and substantially uniformly increases along the length of the intermediate stage.

The single pass drying apparatus is especially useful for efficiently removing moisture from various products such as materials having significant protein and fat contents without deleterious effects on these constituents. It is known that the effectiveness of a heat exchanger is defined by the difference between the inlet temperature and the outlet temperature. More efficient drying is accomplished with the present invention than prior single pass dryers because the apparatus permits higher than conventional air flow velocities while providing an improved $\Delta T$ difference between inlet and outlet temperatures.

2. Description of the Prior Art

Drying of large volumes of fragmented fibrous materials has long been carried out in heat exchangers consisting of one or more elongated, generally horizontally oriented drums. Hot gases are caused to flow through each to remove moisture from the material by heat exchange between the hot gases and the fibrous product. Generally speaking, a burner is disposed to direct hot products of combustion directly into the inlet of the drum which also receives the moisture-bearing material to be dried. However, advantage has also been taken of other sources of waste heat. After removal of the requisite amount of moisture from the material, the dried product is directed into a collector or other receiving means at the outlet of the heat exchange drum. A blower or equivalent device is provided to accomplish the required rate of flow of hot gases through the drum heat exchanger.

Three pass dryers have been used in the past which include a single rotatable drum with concentric stages arranged so that the material being dried traverses the drum in a serpentine fashion. Three pass dryers are relatively expensive but have been used primarily because of the decreased product residence time necessary to obtain adequate drying, while minimizing ground space in the drying plant. A limiting factor in the use of three pass dryers has been the restricted inlet opening of the concentrically arranged drying zones, thus resulting in a fairly severe heat transfer in the first pass. High temperatures have been tolerated in the first pass of the three pass dryers in connection with the drying of alfalfa because the product typically is introduced into the three pass dryer at a moisture level of about 80%. The latent heat transfer that occurs in the first pass thereby protects the product notwithstanding the high temperature level that exists in the first pass drying zone.

In the case of prior single pass dryers, efforts to increase the air flow velocity simply resulted in excessive blowing of the material out of the dryer and resulting inadequate product retention time. A by-product of the decreased retention time was a lessening of the $\Delta T$ between the inlet and outlet temperatures of the dryer. Even at air velocities of no more than about 500 feet per minute, the resulting discharge temperature on most products was found to be in the range of 300° F. to 350° F.

Single pass dryers, as contrasted with three pass dryers, are particularly useful for drying temperature-sensitive products that either have a substantially lower initial moisture content than relatively wet alfalfa, as for example about 30%, or that are blended with previously dried material to bring the moisture content of the product entering the inlet of the dryer to about that moisture level. The single pass dryer may be operated at a substantially higher throughput than a three pass dryer. In addition, high temperature levels in the initial drying stage are avoided as occurs in the first pass of a three pass dryer.

U.S. Pat. No. 4,193,208 illustrates a single pass dryer having inwardly extending internal flighting within the drum which caused the material conveyed through the dryer to be lifted up and then dropped back into the hot gas stream, rather than simply resting at the bottom of the drum as it was rotated. The secondary flighting in the central part of the drum was provided to enhance heat exchange between the hot gases directed through the drum and the product to be dried. In order to prevent hot gases from being blown directly through the dryer from one end to the other, single pass dryers have included transverse plates in the drum to obstruct the flow of hot gases therethrough. The net result of such constructions was to decrease the capacity of the dryer while at the same time interfering with uniform temperature control and preventing maintenance of constant material flow rates through the dryer.

U.S. Pat. No. 5,157,849 illustrates and describes an improved single pass dryer having circumferentially spaced, inwardly directed, product conveying and showering conductive and convective heat transfer flights extending inwardly toward the center of the drum where the total surface area of the flights is at least as about as large as the total heat transfer surfaces of the products to be dried at maximum throughput capacity. The flighting design of the '849 patent leaves a flight-free central showering zone of a size to permit heat exchange and conveyance of material along the length of the dryer at a predetermined rate, and establishes a specific range of diameter ratio between the diameter of the drum and the diameter of the internal cylindrical flight-free central product showering zone.

SUMMARY OF THE INVENTION

The present invention provides an improved single pass drum dryer exhibiting enhanced drying efficiencies while retaining the cost and operational advantages of a single pass dryer, as compared with a three pass unit. Broadly speaking, the drum dryer of the invention includes an elongated, hollow drum having a moist product inlet and a spaced dried product outlet, with a drying chamber between the inlet and the outlet. Flighting is provided within the drum which effectively separates the drying chamber into a plurality of drying stages, including a first stage adjacent the inlet, a final stage adjacent the outlet, and at least one intermediate stage between the first and final stages. The intermediate stage includes a plurality of drying zones arranged in successive order, from a point proximal to the first stage and extending towards the final stage. Each of the zones is configured with internal flighting having heat transfer surfaces that define a predetermined ratio calculated by dividing the total heat transferring surface area within the zone by the volume of the zone. The flighting is arranged so that the heat transfer ratio progressively increases from the first to the final zone within the intermediate stage. In preferred practice, one of the zones proximal to the first stage has a heat transfer ratio of from about 1.5–2.5 $ft^{-1}$, while another of the zones closer to the final stage has a heat transfer ratio of from about 2.75–3.75 $ft^{-1}$.

The preferred design of dryers in accordance with the invention is that the intermediate stage zones are arranged in contiguous relationship, with the first zone being contiguous with the first stage and the last zone being contiguous with the final dryer stage. The number of intermediate stage zones is variable, but usually ranges from 2–8, with four zones being most preferred. In the case of a four zone intermediate stage dryer, the first zone has a heat transfer ratio of from about 1.5–2.5 $ft^{-1}$, the second zone has a heat transfer ratio of from about 1.75–2.75 $ft^{-1}$, the third zone has a heat transfer ratio of from about 2.25–3.25 $ft^{-1}$, and the fourth zone has a heat transfer ratio of from about 2.75–3.75 $ft^{-1}$.

The intermediate stage zones are advantageously equipped with heat transfer flighting which presents a series of inwardly extending, circumferentially spaced apart metallic heat transfer panels, with the number of panels in each of the zones increasing from the first to the last zone. In practice, the panels are supported on corresponding strut elements coupled to the inner surface of the drum; these strut elements support L- and Z-shaped members which cooperatively define the individual panels.

The final stage of the preferred dryer has a heat transfer ratio smaller than the heat transfer ratio of any of the intermediate stage zones, and is preferably designed as a curing chamber of the type described in U.S. Pat. No. 5,157,849, incorporated by reference herein.

In operation, initially moist product (e.g., distillers grain, bakery wastes, alfalfa, peat moss, wood materials or similar particulates) is introduced into the dryer inlet along with heated air during rotation of the drum. Typically, the moisture content of the incoming product would range from about 30–70% by weight, while the inlet air temperature would be from about 600–1800° F.; where distillers grain products are being dried, the temperature would be normally be from about 550–700° F. Air flow rates through the dryer would commonly range from about 60,000 CFM to about 180,000 CFM.

As the product is advanced along the length of the drum by virtue of drum rotation and passage of air therethrough, it is progressively dried. At the same time, the air temperature decreases along the drum length. In the distillers grain example, the air would have a temperature of around 450° F. as it enters the intermediate stage, and a temperature of about 225–250 ° F. into the third stage. The exiting air would have a temperature on the order of 190° F. In the first stage, product drying is primarily from convective heat transfer, while in the second stage a combination of convection and conductive drying is carried out in the final stage, almost all of the product drying is accomplished by conduction.

The progressively increasing lighting density within the intermediate stage drying zones is important in obtaining high drying efficiency. First of all, as the product loses moisture during passage through the drum it becomes lighter, and more conductive heat transfer surface area is required to continue the drying process as the product lightens. However, the lighter product will increase the pneumatic influence on the flow of the product. Thus, product travel is reduced for a given air flow through the dryer, so that air flow velocities can be increased while still maintaining the desired air discharge temperatures.

DETAILED DESCRIPTION OF THE PREFERRED EMBODIMENTS

Figure 1:
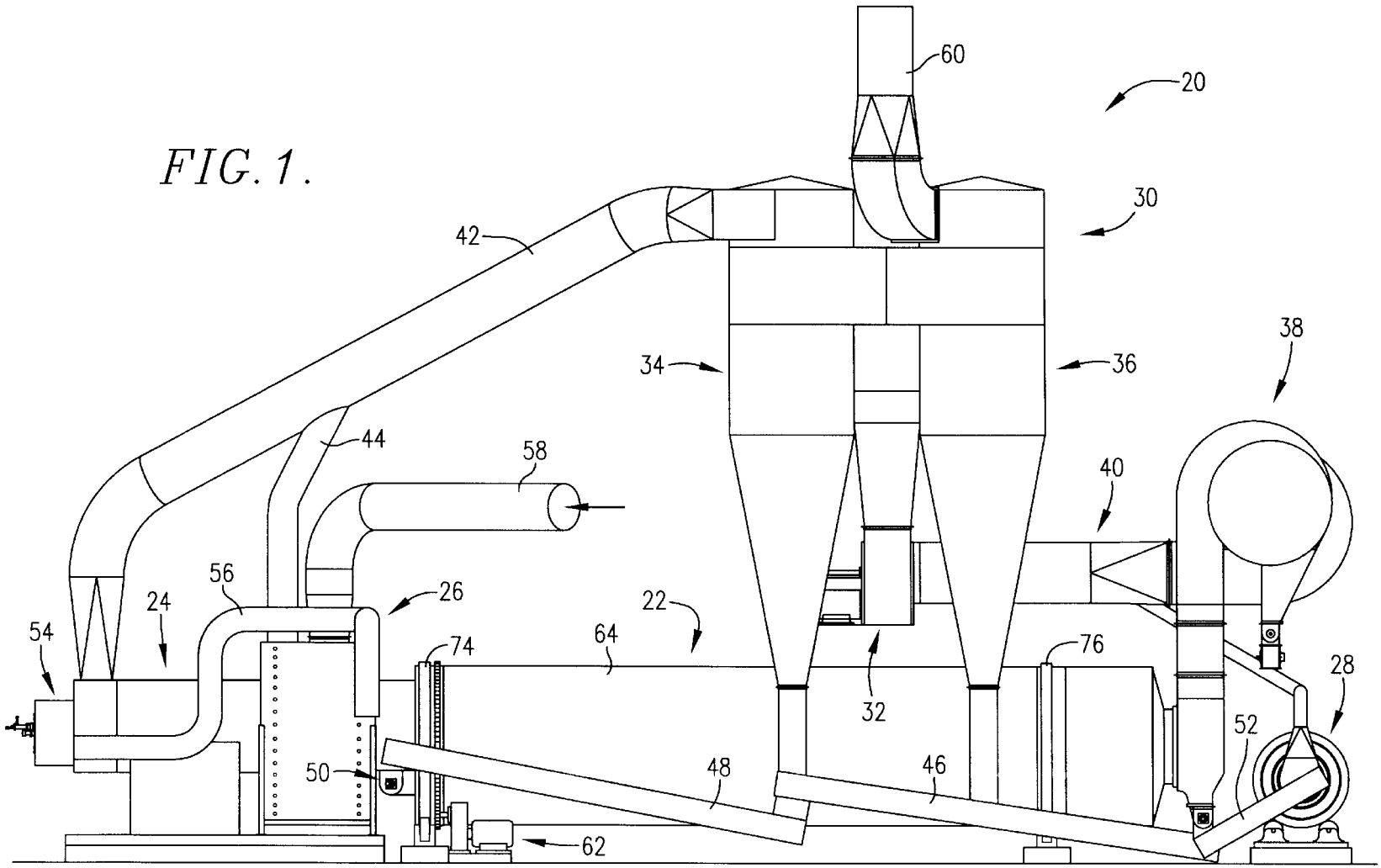
FIG. 1 is an elevational view of an overall product drying assembly including the preferred rotary drum dryer of the invention as a part thereof.

Turning now to the drawings, an overall product drying assembly 20 in accordance with the invention includes a rotary drum dryer 22 adapted to receive and dry a particulate material, with a furnace 24 and blending chamber 26 adjacent the inlet of the dryer 22, and a cooling drum 28 at the outlet end of the drum for receiving and cooling dried product. The assembly 20 further includes an air-handling unit 30, including a primary fan 32, recycle collector 34, discharge collector 36, dual inlet centrifugal separator 38, and ducting 40 interconnecting the collectors 34–38 and fan 32. An optional return air conduit 42 extends from the top of recycle collector 34 to the inlet of furnace 24, and has an intermediate blending air conduit 44 leading to chamber 26. A pair of tandem-mounted product recycle screw conveyors 46 and 48 extend along the length of drum 22 from the outlet end thereof to a product input conveyor 50, and receive output from the collectors 34 and 36. Similarly, a dried product screw conveyor 52 extends from the outlet end of the dryer 22 to cooling drum 28. The furnace 24 is equipped with a gas-fired burner 54 as well as a gas recycle conduit 56 from blending chamber 26. The latter may include a boiler gas recycle duct 58 as shown. Air discharge from the assembly 20 is provided via discharge duct 60 coupled to collector 36.

During use of the assembly 20, the dryer 22 is rotated (typically at a speed of from about 3–12 rpm) by means of trunnion drive 62, while heated air is delivered to the input end of the drum by means of furnace 24, blending chamber 26 and air handling unit 30. Initially moist product is delivered to conveyor 46 by conventional means (not shown), with a predetermined portion of partially dried product being transferred by conveyors 46, 48 from the outlet end of the dryer back to conveyor 46 for recycling through the dryer. The air-handling unit 30 serves to move air throughout the assembly 20, with exhaust through duct 60 and product dropout through the collectors 34–36–38, as will be understood by those skilled in the art.

The drum dryer 22 includes an elongated, circulated in cross section tubular metallic shell 64 presenting an inlet 66 defined by inwardly extending, flanged circular wall 68, and an outlet 70 formed by a flanged, tapered segment 72 of the shell 64. It will be observed that the inlet 66 and outlet 70 are essentially concentric and in opposed relationship. A pair of trunnion tracks 74, 76 are secured to the outer surface of shell 64 and engage corresponding trunnion wheel assemblies.

Figure 2:
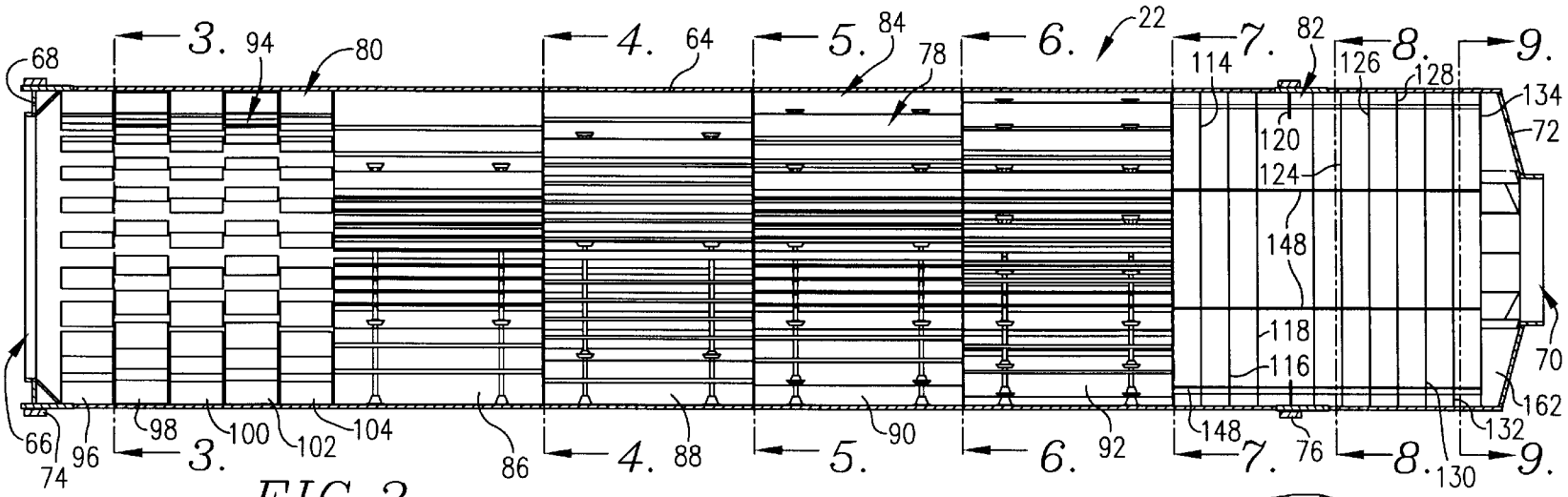
FIG. 2 is a vertical sectional view of the preferred drum dryer depicted in FIG. 1.

Referring to FIG. 2, it will be seen that the interior of drum dryer 22 is provided with differently configured heat transfer flighting along the length thereof between inlet 66 and outlet 70, effectively forming an internal drying chamber 78 presenting a first stage 80 (Dryer Stage I), a final stage 82 (Dryer Stage III), and an intermediate stage 84 (Dryer Stage II). The intermediate stage 84 is in turn subdivided into four contiguous drying zones 86 (Zone I), 88 (Zone II), 90 (Zone III), and 92 (Zone IV), with the first zone 86 being contiguous with first stage 80 and fourth zone 92 contiguous with final stage 82.

Figure 3:
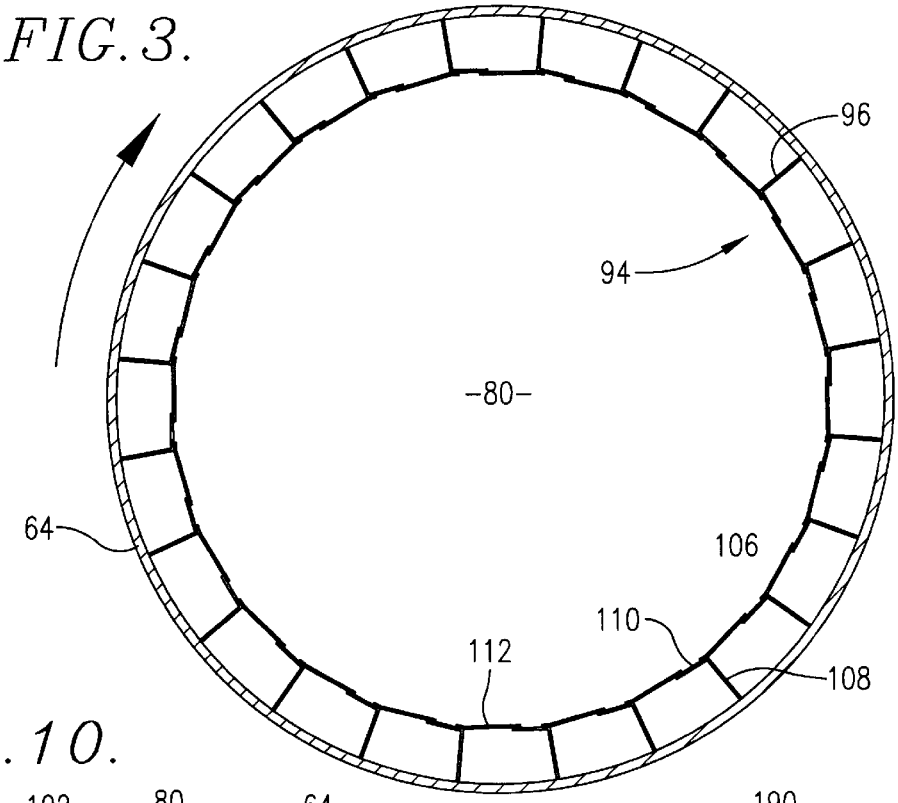
FIG. 3 is a vertical sectional view taken along line 3—3 of FIG. 2 and illustrating the flighting used in the first drying stage of the drum dryer.
Figure 10:
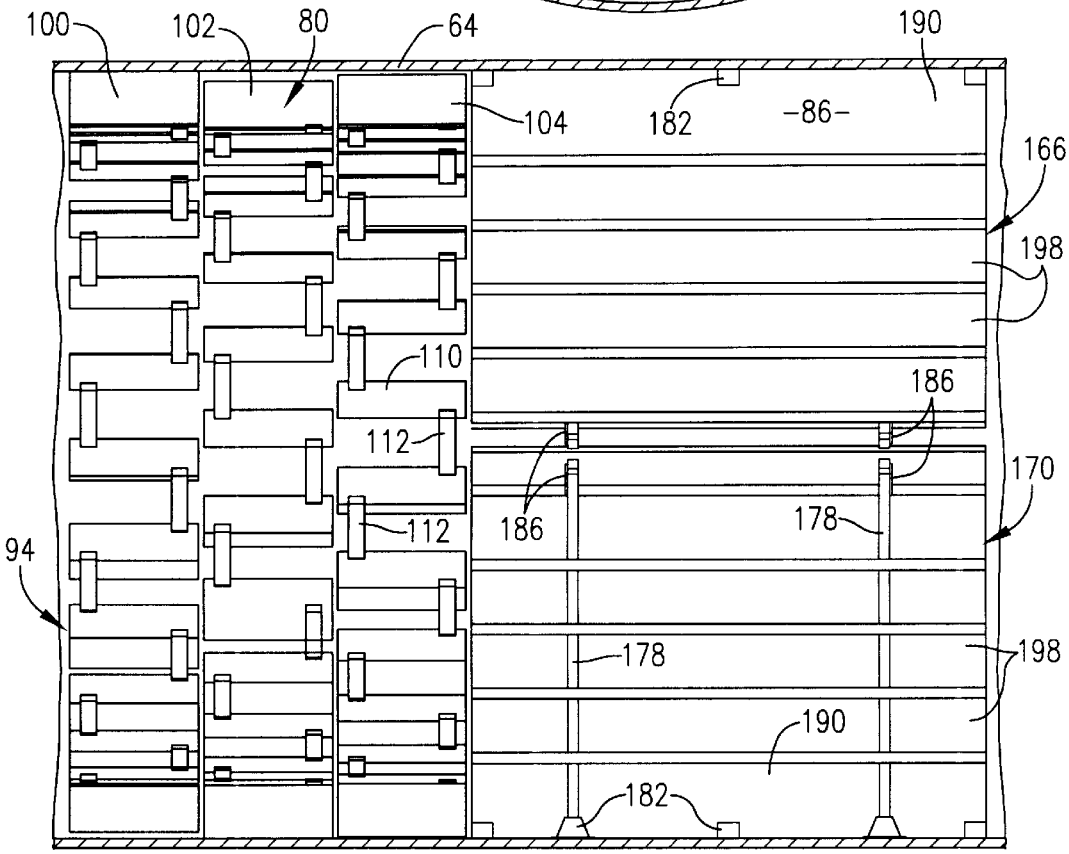
FIG. 10 is an enlarged, fragmentary vertical sectional view of a portion of the drum dryer and depicting in greater detail the flighting employed in the first stage and the initial zone of the intermediate stage of the dryer.

The first stage 80 is equipped with flighting broadly referred to by numeral 94 (see FIGS. 3 and 10) comprising a total of five adjacent, axially spaced apart rows 96–104 of flighting elements. Each of the rows 96–104 is made up of a plurality of identical, circumferentially spaced apart L-shaped flighting members 106, each presenting a first leg 108 secured to the inner surface of shell 64 by welding or the like, and a transverse leg 110 in spaced relationship from the shell 64. As best seen in FIGS. 3 and 10, the adjacent transverse legs 110 in each of the flighting rows 96–104 are interconnected by elongated metallic straps 112. It will also be seen that the flighting members 106 of each of the rows 96–104 are circumferentially offset from the flighting members in adjacent rows. In the illustrated embodiment, each successive row 98–104 is offset 5° from the preceding row.

Figure 8:
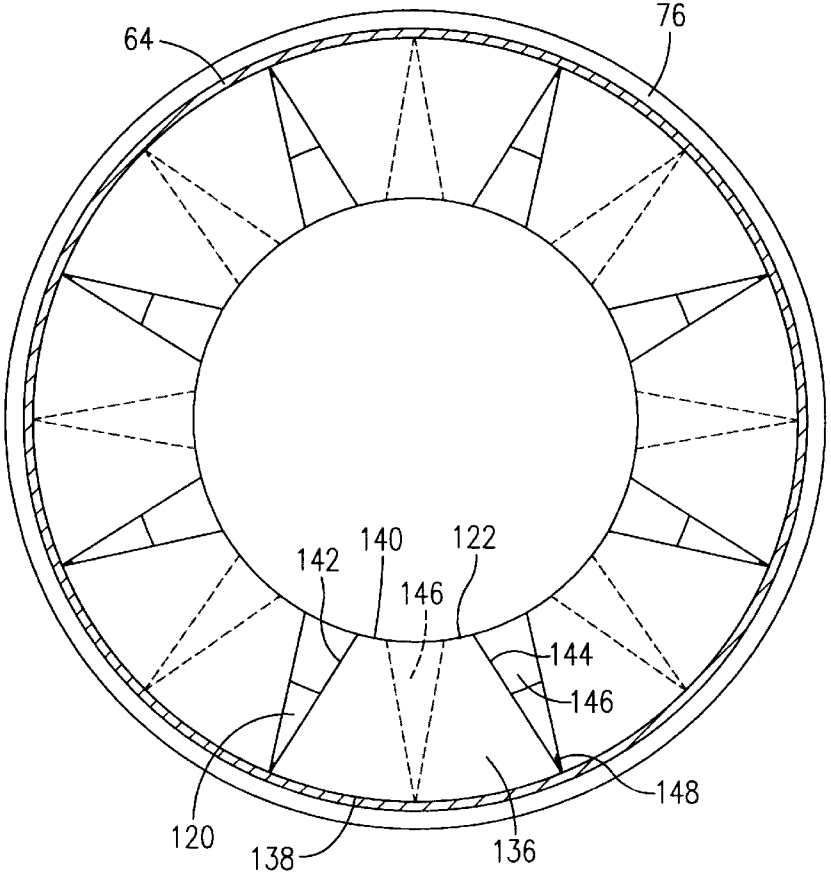
FIG. 8 is a vertical sectional view taken along line 8—8 of FIG. 2 and illustrating the flighting used in the final drying stage of the drum dryer.

The final stage 82 is in effect a curing stage for the product prior to exiting from the dryer 22, and is described in U.S. Pat. No. 5,157,849 incorporated by reference herein. This stage is equipped with an inner set of three sector plate assemblies 114–118, an intermediate, inwardly extending annular wall 120, a further set of six sector plate assemblies 122–132 and a final sector plate assembly 134. Each of the sector plate assemblies 114–118 and 122–132 are identical and include (see FIG. 8) a plurality of circumferentially arranged, somewhat trapezoidal plates 136 each presenting an arcuate outer margin 138 secured by welding or the like to the inner face of shell 64, a complemental, arcuate inner margin 140 and a pair of side margins 142, 144 which diverge from the ends of inner margin 140 to the ends of outer margin 138. The plates 136 are arranged in close proximity at their respective outer margins 138 thereby defining a series of substantially V-shaped passageways 146 between adjacent pairs of the plates 136. Adjacent ones of the sector plate assemblies 114–118 and 122–132 are offset from each other so that the V-shaped passageways 146 formed by each of the sector plate assemblies are likewise offset as depicted in FIG. 8. Finally, the stage 82 has a plurality of elongated, axially extending vanes 148 secured to the interface of shell 64.

Figure 9:
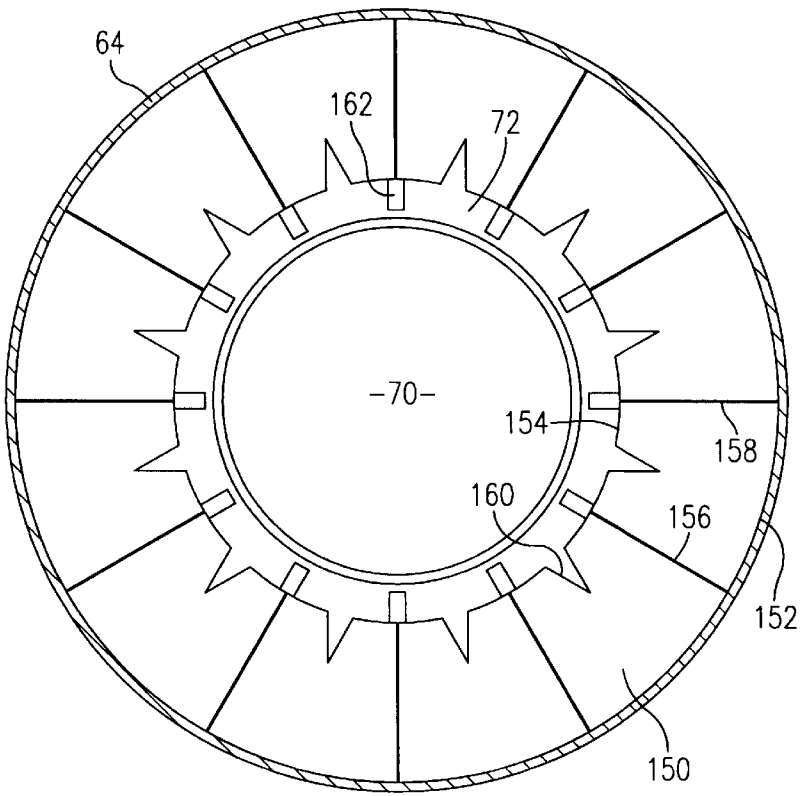
FIG. 9 is a vertical sectional view taken along line 9—9 of FIG. 2 and illustrating additional flighting used in the final drying stage of the drum dryer.

The final sector plate assembly 134 is depicted in FIG. 9 and is made up of a series of circumferentially arranged sector plates 150 each presenting an outer margin 152 secured to shell 64, inner margin 154 and side margins 156, 158. A shallow V-shaped groove 160 is formed at the center of each plate 150 as illustrated.

A series of circumferentially spaced lifter plates 162 are located between the outer surface of sector plate assembly 134 and the inner face of shell segment 72. The plates 162 extend from the main body of shell 64 to a point adjacent the outlet 70.

The intermediate stage 84 is designed so that the heat transfer ratio defined thereby progressively increases from the inlet end of the stage adjacent first stage 80 to the outlet end of the stage adjacent final stage 82. In the preferred embodiment, the heat transfer ratio progression is obtained by the construction and density of the flighting components within each of the zones 86–92, such that the heat transfer ratio in zone 86 is from about 1.5–2.5 $ft^{-1}$, from about 1.75–2.75 $ft^{-1}$ in zone 88, from about 2.25–3.25 $ft^{-1}$ in zone 90, and from about 2.75–3.75 $ft^{-1}$ in zone 92.

Figure 12:
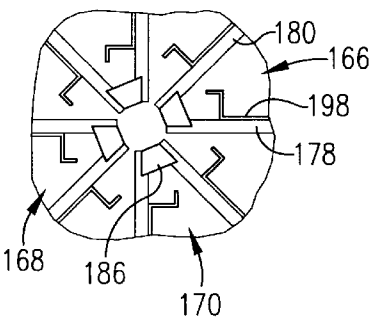
FIG. 12 is a fragmentary view illustrating the configuration of the inner section of the flighting used in the second zone of the intermediate stage.
Figure 4:
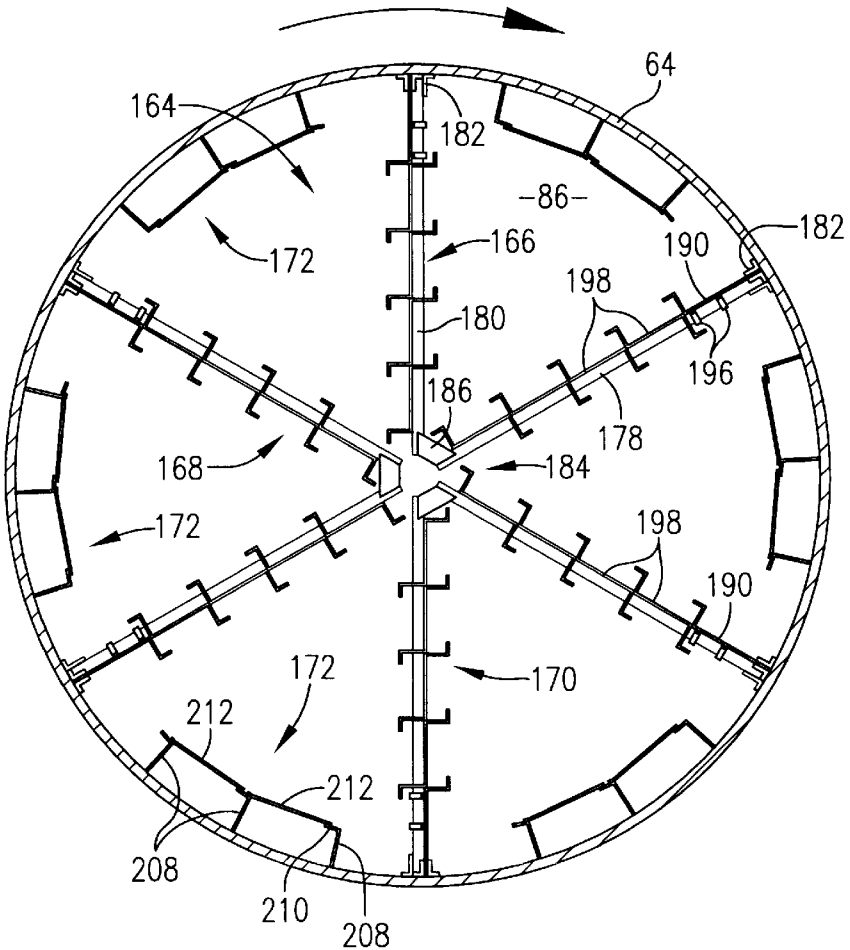
FIG. 4 is a vertical sectional view taken along line 4—4 of FIG. 2 and illustrating the flighting used in the first drying zone of the intermediate stage of the drum dryer.

In particular, and referring to FIGS. 4 and 12, the flighting assembly 164 within first drying zone 86 includes three V-frame assemblies 166, 168 and 170 spaced about the interior of the shell 64 with intermediate L members 172 within each V-frame assembly and between the respective assemblies.

Figure 11:
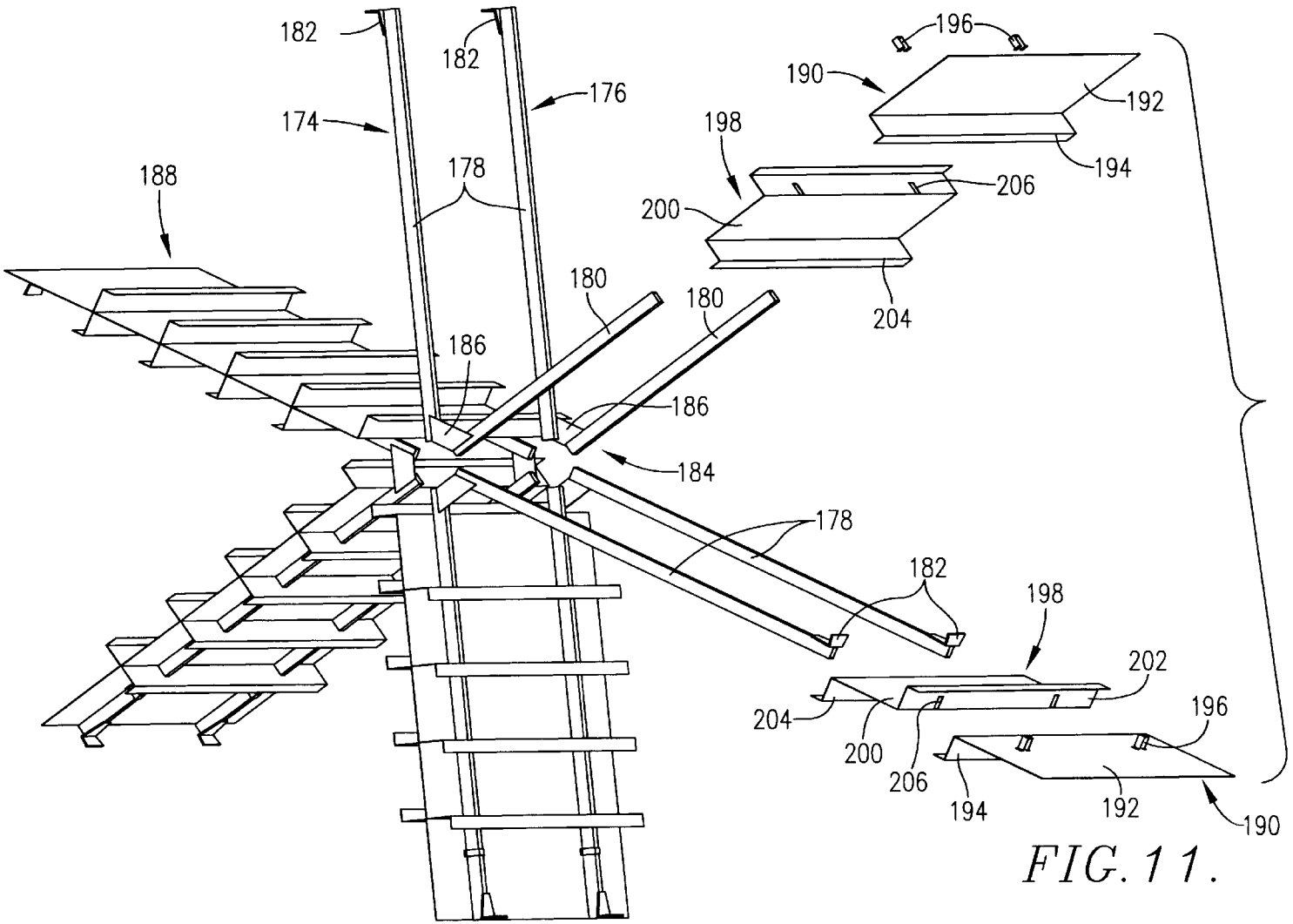
FIG. 11 is an exploded view illustrating the construction of the preferred flighting used in the intermediate stage of the drum dryer.

In more detail, each V-frame assembly 168–170 includes two aligned strut units 174 and 176 (see FIG. 11), with each strut unit made up of a pair of strut tubes 178 and 180. The strut tubes 178, 180 are secured to the inner face of shell 64 by means of weld brackets 182 and extend inwardly in a radial direction to an apex 184. Generally trapezoidal gusset plates 186 interconnect the inner ends of the tubes 178, 180. The aligned strut tubes 178 and 180 of each strut tube unit 174, 176 support elongated, metallic heat transfer plates 188, i.e., the plates 188 bridge the aligned tubes 178 and the aligned tubes 180. The plates 188 include an outermost, somewhat L-shaped plate 190 having a laterally extending segment 192 and a short, transverse segment 194. The L-shaped plate 190 is secured to the outboard ends of the aligned tubes 178, 180 by welding using clips 196. In addition, the plates 188 include a series of generally Z-shaped intermediate plates 198 supported on the aligned tubes 178, 180. Specifically, each of the Z-shaped plates 198 includes a central planer segment 200, an apertured, outboard transverse segment 202 and an inboard transverse segment 204. Each segment 202 has a pair of spaced apart openings 206 formed therein which are adapted to receive the respective tubes 178 or 180. During construction, a series of the Z-shaped plates 198 are slid onto the aligned tubes 178 and 180 so that the plates 198 are in abutting contact, and these are welded in place to the strut tubes. The outermost L-shaped plate 190 is then positioned on the outer ends of the aligned struts and secured in place via welding and the clips 196. At this point the end most brackets 182 are welded to the strut tubes permitting the entire V-frame to be secured to shell 64. In preferred practice, the plates 190 and 198 extend the full width of the zone 86 and may be of any desired length, e.g., 8 feet.

It will thus be appreciated that the flighting assembly 164 presents a total of six generally radially oriented, spaced apart, essentially continuous heat exchange panels defined by the plates 188 which extend the full length of the zone 86.

The flighting within zone 86 also includes the L-shaped members 172. In particular, three such members 208 are secured to the shell 64 by welding between the legs of each V-frame assembly and between the respective V-frame assemblies as shown in FIG. 4. Each of the members 208 includes a transverse inner leg 210, and connecting straps 212 are welded between the legs 210 as shown. The members 208 extend the full length of zone 86, in this embodiment eight feet.

Figure 5:
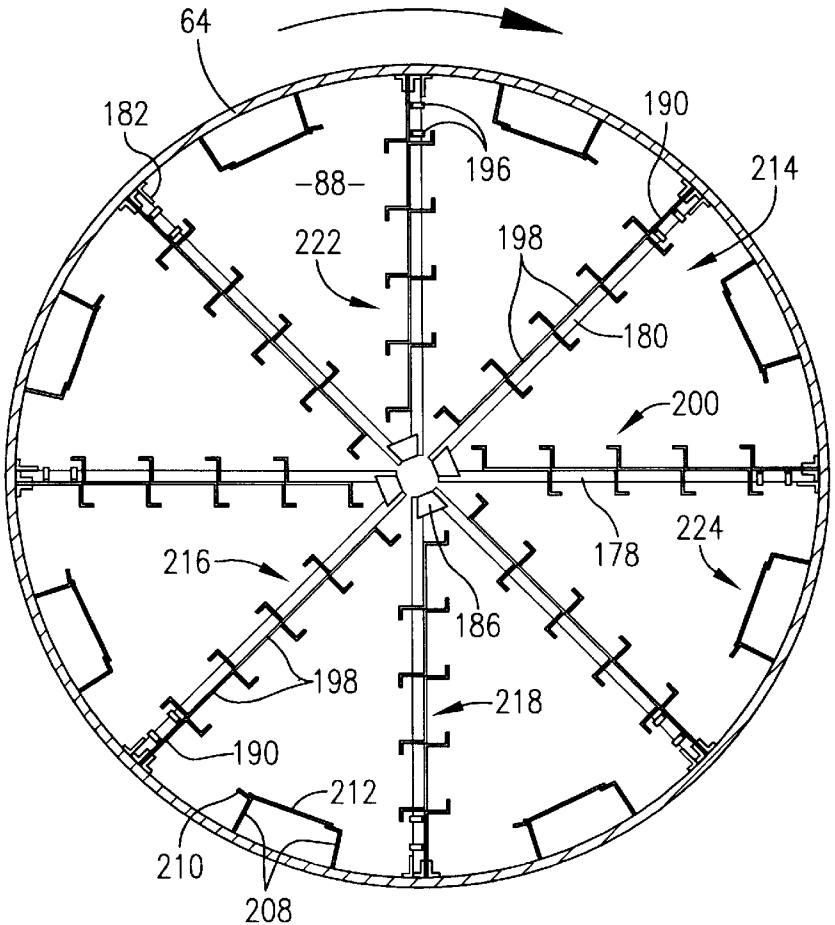
FIG. 5 is a vertical sectional view taken along line 5—5 of FIG. 2 and illustrating the flighting used in the second drying zone of the intermediate stage of the drum dryer.

Attention is next directed to FIGS. 2, 5, and 12 which illustrate the construction of second drying zone 88. In this instance the flighting 214 within the zone is made up of four V-frame assemblies 216, 218, 220, and 222, along with L-shaped members 224. Each of the V-frame assemblies 216–222 is identical and is constructed in the same manner as the assemblies 166–170 of first drying zone 86; the only difference between the V-frame assemblies is that those within second drying zone 88 present a smaller apex angle as compared with the assemblies within first drying zone 86. Therefore, the parts within V-frame assemblies 216–222 are identical with parts found within assemblies 166–170 and are numbered using the same reference numerals used in connection with the assemblies 166–170. Similarly, the L-shaped members 224 include L-members 208 and straps 212. In the case of zone 88 however, only two of the L-members 208 are used between the struts of each of the V-frame assemblies 216–222, and between the respective assemblies.

Thus, in second drying zone 88 the flighting 214 presents a total of eight radially and longitudinally extending, spaced apart, essentially continuous heat exchange panels, so that the panel density within zone 88 is increased relative to that of zone 86.

Figure 13:
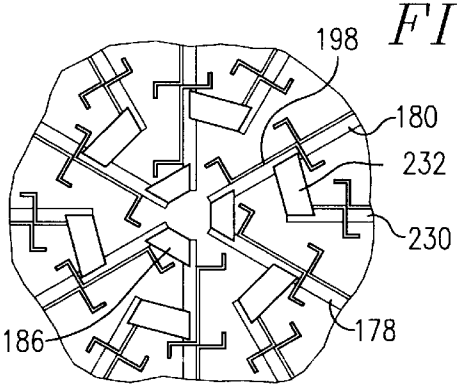
FIG. 13 is a fragmentary view illustrating the configuration of the inner section of the flighting used in the third zone of the intermediate stage.
Figure 6:
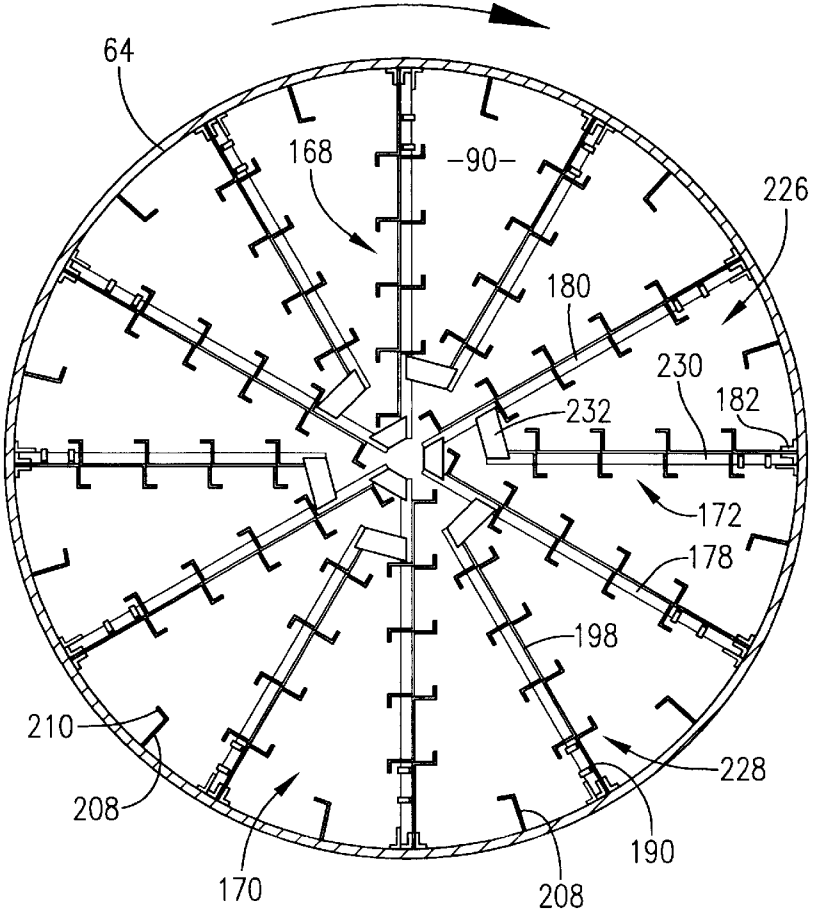
FIG. 6 is a vertical sectional view taken along line 6—6 of FIG. 2 and illustrating the flighting used in the third drying zone of the intermediate stage of the drum dryer.

The construction of third drying zone 90 is depicted in FIGS. 2, 6, and 13. In this case the flighting 226 makes use of the V-frame assemblies 166–172 of flighting assembly 164, which have been modified by the addition of supplemental flighting 228, and the use of L-shaped members 208. In particular, and referring to FIG. 6, it will be seen that each of the strut pairs 178, 180 of each V-frame assembly has attached thereto a bisecting strut assembly made up of two aligned strut tubes 230, which are secured to shell 64 via brackets 182 and to the corresponding strut tube pairs by gusset plates 232. Each of the tube pairs 230 supports an outboard L-shaped plate 190 and a series of Z-shaped plates 198, these being constructed and installed as described in connection with the flighting 164 of zone 86. As illustrated in FIG. 6, only a single L-shaped member 208 is welded to shell 64 between the respective aligned struts of the assemblies 168–172 and the strut pairs 230.

As best seen in FIG. 6, the third zone 90 has a total of twelve of the radially and longitudinally extending, substantially continuous heat exchange panels, again representing an increase in density of the flighting surface as compared with the preceding zone 88.

Figure 14:
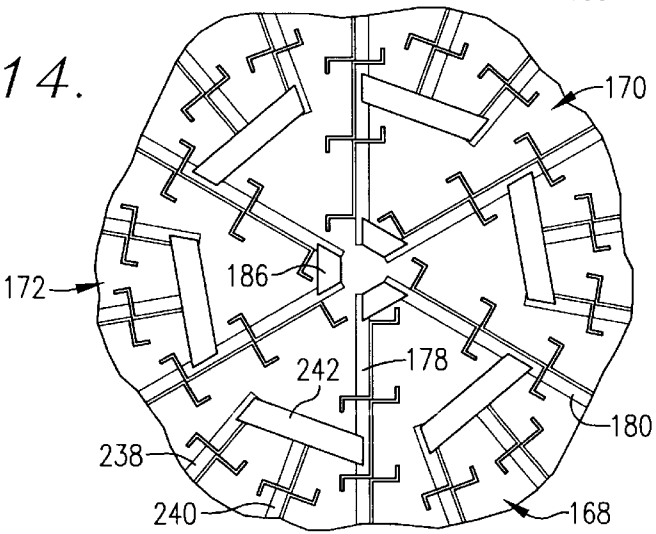
FIG. 14 is a fragmentary view illustrating the configuration of the inner section of the flighting used in the fourth zone of the intermediate stage.
Figure 7:
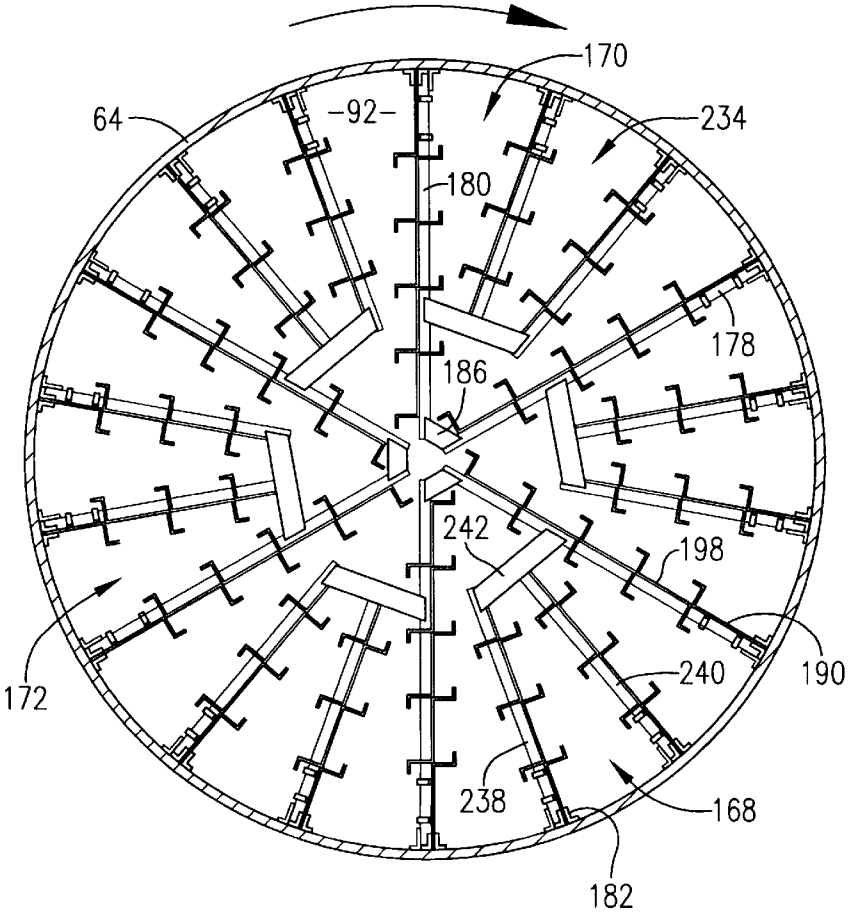
FIG. 7 is a vertical sectional view taken along line 7—7 of FIG. 2 and illustrating the flighting used in the fourth drying zone of the intermediate stage of the drum dryer.

FIGS. 2, 7, and 14 illustrate the construction of fourth drying zone 92, containing the highest density of flighting. In particular, the flighting assembly 234 of this zone again includes the V-frame assemblies 168–172 secured to shell 64, but in this case supplemental flighting 236 is made up of two additional strut units secured to each of the strut pairs 178, 180. In particular, an aligned strut pair 238 and an aligned strut pair 240 are secured to shell 64 and extend inwardly therefrom. A gusset plate 242 is used to connect each of the struts 238,240 to a corresponding V-frame assembly leg 178 or 180. Again, the tube pairs 238, 240 are identical with the pairs of strut tubes making up the V-frame assemblies, except that the pairs 238, 240 are shorter. Each of these strut tube pairs support an outer L-shaped plate 182 as well as a plurality of Z-shaped plates 198.

The final drying zone 92 (FIG. 7) has eighteen of the individual, radially and longitudinally extending heat exchange panels defined by the L-shaped plates and Z-plates of the V-frame assemblies and the supplemental flighting 236. As will be readily appreciated, this represents a still further increase in density of the heat exchange panels as compared with zone 90.

Drying assembly 20 is designed for higher than conventional air flow velocities. A drum dryer 22 of essentially the same diameter and effective length as a conventional single pass dryer which is typically operated at an air flow velocity of 60,000 CFM, may be operated at an air flow velocity at least double that typical air flow. In particular, a twelve foot diameter drum dryer 22 constructed in accordance to the concept of this invention and which for example may be 44 to 58 feet in length, may be operated at air flow velocities of 100,000 to 180,000 CFM, and usually at least about 120,000 CFM. In addition, the temperature of the gases introduced into the inlet 66 of the dryer 22 may range from 500° F. to as much as 1,800° F. In the case of products to be dried that contain a protein and/or fat content that is to be protected against excessive temperatures, and that normally is introduced into the dryer at a moisture level of about 30% to 40% by weight, the inlet temperature of the drying airstream is usually recommended to be less than 700° F. An especially important advantage of the drying assembly 20 of this invention is the fact that the temperature in the outlet of the drum dryer 20, in the case of a 700° F. inlet temperature, will be no more than about 180° F. to 200° F., when the drum is rotated from 4 to 12 rpms and usually about 6 rpms.

When operation of a conventional three pass dryer in which the air flow velocity is about 60,000 CFM is compared with the single pass dryer of this invention operated at an air flow velocity twice that of the three pass dryer and assuming that both are used to dry a 30% moisture product, the heat exchange capacity of the present drum dryer 22 is more than 2× that of the three pass dryer. In an illustrative example, where the temperature of the drying gases entering the inlet of both dryers is of the order of about 700° F., the outlet temperature of a three pass dryer will be at least about 230° F., while drum dryer 22 will exhibit an outlet temperature of no more than about 190° F. In this typical example, the $\Delta T$ of the three pass dryer is about 470° F. In the case of dryer 22, the $\Delta T$ is about 510° F. Thus, the drum dryer 22 has 2.16 times more heat exchange capacity than the three pass dryer (ratio of 510° F. divided by 470° F. times the 2× air flow).

Although a preferred drum dryer 22 in accordance with this invention contains 6, 8, 12 and 18 radial flighting arms as illustrated in the drawings, it is to be understood that in many instances improved results may be obtained using a radial flight arm distribution of 6, 12 and 18 radial flights. When wet material having an initial moisture content of about 30% is introduced into the inlet 66 of drum dryer 22 at a preferred inlet temperature of about 700° F. and the inlet air velocity is of the order of 180,000 CFM, the temperature of the material entering the intermediate stage 84 will generally be about 400° F. to 450° F. The temperature of the material entering the curing or final stage 82 will be about 225° F. to 270° F., and the outlet temperature will be from about 180° F. to 200° F. The air volume out of the outlet 70 of the drum dryer 22 will nominally be about 120,000 CFM. Most importantly, the temperature of the heat transfer media or air/water vapor mixture as it is conveyed through the first, second and third drying zones 86–92 of intermediate stage 84 decreases relatively uniformly, and is consecutively lowered about 60° F. through each stage.

As material dries along the length of a single pass dryer, the particles tend to accelerate as the moisture content decreases and the particles become lighter, even though there is some decrease in velocity of the air flow. It is to be recognized that material being dried is initially carried by the surfaces of the radial flighting in each of the zones 86–92 until such time as the material may fall from the flighting surface as a result of gravity. Thus, material falls from a respective radial flight surface twice during each rotation of the drum.

In first drying zone 86 having six radial flights, the material during each 180° of rotation of the drum will fall a distance that averages ⅓ the diameter of the drum. In drying zone 90 having 12 radial flights, the material during each 180° of rotation of the drum will fall a distance approximately ⅙ of the diameter of the drum. Accordingly, in drying zone 88 having eight radial flights, the average fall distance of the material during each 180° of rotation is a little more than ¼ of the diameter of the drum, while in drying zone 92 having 18 radial flights, the average fall distance of the material during each 180° of rotation of the drum is about ⅑ of the diameter of the drum. Accordingly, conductive heat transfer as contrasted with convective heat transfer gradually increases throughout the length of the intermediate stage 86 and the tendency of the particles to accelerate as they become drier and lighter in weight is offset by the interference to flow of the particles afforded by the flighting in respective zones 86–92. The residence time of the material therefore successively increases in each of the zones 88–92, offsetting the tendency for the velocity of material to gradually increase along the length of the dryer as the particles dry out. As a consequence, a greater quantity of material may be maintained in the intermediate stage 84, thus significantly increasing the drying capacity of assembly 20 even though a high air flow velocity is maintained throughout the length of the dryer.

The drum dryer 22 of assembly 20 is particularly useful for drying products that have a relatively high fat content, as for example distillers grain that is generally known as DDGS. Other materials that may beneficially be dried in assembly 20 include hydrolyzed feather meal, potato waste, high fat bakery feed or fish meal which has very fragile oils. In most instances, a proportion of the dried material out-feed from drum dryer 22 will be recycled back to the inlet of the dryer for blending with the moist product to provide an inlet moisture content of about 30% to 40%, and usually about 30%. This results in the product being more granular in nature and better exposes the particles to the drying medium.

EXAMPLE

The following table sets forth a computer program generated material balance of operating examples of a dryer constructed and operated in accordance with this invention as depicted in the drawings and described in detail above, having a nominal diameter of 12' and 56' in length with an 11' long first stage 80, a 32' long second stage 86 divided into four approximately equal length zones 86–92 and a 12' long third stage 82. Different product production rates are compared at a fixed air flow volume. The production rates in the operative example are 8, 10, 12, 14 and 16 dry tons per hour, respectively. The dryer discharge air flow is maintained constant at 120,000 CFM for each of the production rates.

It can be seen from the table below that at a production rate of 12 tons per hour in the exemplary 12'×56' dryer, the material undergoing drying has successive average residence times of: about 0.95 minutes in Stage I (80); about 0.75 minutes in Stage II, Zone I, (86); about 0.65 minutes in Stage II, Zone II (88); about 0.60 minutes in Stage II, Zone III (90); about 0.55 minutes in Stage II, Zone IV (92). The average residence time in Stage III (82) is about 3.15 minutes. The total average residence time is about 6.65 minutes.

In the drying operations set forth in the table below, approximately 58% of the input to the dryer is product that has been previously dried to bring the moisture level thereof from a typical range of 60%–70% to a level of about 30%–40% as inputted to Stage I (80) of the dryer. Also of note is the fact that with a required Stage I inlet temperature of about 561° F. where the production rate is 8 dry tons per hour, the dryer discharge temperature is only 238° F. Even though the Stage I inlet temperature will need to be about 832° F. in the example of processing about 16 dry tons per hour of material, the dryer discharge temperature in that instance will be no more than about 195° F.

| INPUT DATA | | | | | | |
|---|---|---|---|---|---|---|
| Wet Feed Moisture Content | 67.03% | 67.03% | 67.03% | 67.03% | 67.03% | |
| Dry Feed Moisture Content | 10% | 10% | 10% | 10% | 10% | |
| Excess Air Added to Front of Furnace | 200% | 160% | 120% | 80% | 40% | |
| Recycle as a % of Stack Flow | 58% | 52% | 49% | 46% | 45% | |
| % of Recycle Added to Front of Furnace | 50% | 50% | 50% | 50% | 50% | |
| % of Boiler Stack Flow | 50% | 62.5% | 75% | 87.5% | 100% | |
| Stack Temperature | 230 | 220 | 210 | 200 | 190° F. | |
| Production Rate | 8.0 | 10.0 | 12.0 | 14.0 | 16.0 | Dry Ton/hr |
| **OUTPUT DATA** | | | | | | |
| Theoretical Heat Requirement | 1,137.4 | 1,091.5 | 1,052.6 | 1,018.8 | 988.9 | Btu/$lb_m$ $H_2O$ |
| Actual Heat Required | 35.662 | 42.724 | 49.353 | 55.591 | 61.474 | MMBtu/hr |

-continued

| | | | | | | |
|---|---|---|---|---|---|---|
| Water Evaporated | 3,459 | 3,459 | 3,459 | 3,459 | 3,459 | $lb_m$/ton |
| Water Evaporated | 27,673 | 34,592 | 41,510 | 48,428 | 55,347 | $lb_m$/hr |
| Furnace Inlet Temperature | 165.06 | 154.93 | 147.99 | 143.67 | 141.60° F. | |
| Furnace Discharge Temperature | 759.81 | 877.42 | 1004.12 | 1144.13 | 1302.32° F. | |
| Dryer Stage I Inlet Temperature | 560.90 | 630.32 | 699.00 | 766.53 | 832.37° F. | |
| Dryer Stage II Zone I Inlet Temperature | 451.02 | 493.21 | 534.92 | 575.88 | 615.72° F. | |
| Dryer Stage II Zone II Inlet Temperature | 386.39 | 412.56 | 438.40 | 463.73 | 488.28° F. | |
| Dryer Stage II Zone III Inlet Temperature | 334.68 | 348.04 | 361.19 | 374.01 | 386.33° F. | |
| Dryer Stage II Zone IV Inlet Temperature | 289.43 | 291.58 | 293.63 | 295.50 | 297.12° F. | |
| Dryer Curing Chamber Inlet Temperature | 257.12 | 251.26 | 245.37 | 239.42 | 233.40° F. | |
| Dryer Discharge Temperature | 237.73 | 227.06 | 216.41 | 205.78 | 195.17° F. | |
| Temperature Differential (ΔT) | 323.17 | 403.26 | 482.59 | 560.75 | 637.21° F. | |
| Saturation Temperature at Specific Humidity | 158.98 | 162.70 | 166.52 | 170.49 | 174.68° F. | |
| Specific Volume of Dryer Discharge Gas | 26.29 | 26.98 | 27.82 | 28.90 | 30.32 | $ft^3$ wet/$lb_m$ dry |
| Volumetric Flow of Furnace Discharge Gas | 108,093 | 115,517 | 121,561 | 126,207 | 129,366 | cfm |
| Volumetric Flow of Dryer Inlet Gas | 157,597 | 165,773 | 173,604 | 181,051 | 188,068 | cfm |
| Dryer Inlet velocity | 3,739 | 3,933 | 4,119 | 4,295 | 4,462 | ft/min |
| Recycle Stack Flow | 69,348 | 62,951 | 58,296 | 55,181 | 53,437 | cfm |
| Stack Flow to Atmosphere | 50,652 | 57,049 | 61,704 | 64,819 | 66,563 | cfm |
| Total Dryer Discharge Flow | 120,000 | 120,000 | 120,000 | 120,000 | 120,000 | cfm |
| Dryer Discharge Velocity | 3,118 | 3,118 | 3,118 | 3,118 | 3,118 | ft/min |

TYPICAL RESIDENCE TIME AT 12 TON/HR (Production Rate)

| | |
|---|---|
| Stage I | |
| Minimum Time | 0.65 min |
| Maximum Time | 1.25 min |
| Average Time | 0.95 min |
| Stage II, Zone I | |
| Minimum Time | 0.50 min |
| Maximum Time | 1.00 min |
| Average Time | 0.75 min |
| Stage II, Zone II | |
| Minimum Time | 0.40 min |
| Maximum Time | 0.90 min |
| Average Time | 0.65 min |
| Stage II, Zone III | |
| Minimum Time | 0.40 min |
| Maximum Time | 0.80 min |
| Average Time | 0.60 min |
| Stage II, Zone IV | |
| Minimum Time | 0.40 min |
| Maximum Time | 0.70 min |
| Average Time | 0.55 min |
| Curing Chamber | |
| Minimum Time | 2.80 min |
| Maximum Time | 3.50 min |
| Average Time | 3.15 min |
| Total Minimum Residence Time | 5.15 min |
| Total Maximum Residence Time | 8.15 min |
| Total Average Residence Time | 6.65 min |

We claim:

1. A rotary drum dryer, comprising:

an elongated, hollow drum having a moist product inlet and a spaced dried product outlet, with a drying chamber between the inlet and the outlet;

fighting within said drum dividing the chamber into a plurality of drying stages along the length of the chamber, including a first stage adjacent said inlet, a final stage adjacent said outlet, and at least one intermediate stage between the first and the final stages, said intermediate stage including four drying zones arranged in successive order from a point proximal to said first stage and extending towards the final stage, each of said zones configured to define a heat transfer ratio calculated by dividing the total heat-transferring surface area within the zone by the volume of the zone, a first zone of said intermediate stage having a heat transfer ratio of from about 1.5–2.5 $ft^{-1}$, a second zone adjacent said first zone and having a heat transfer ratio of from about 1.75–2.75 $ft^{-1}$, a third zone adjacent said second zone having a heat transfer ratio of from about 2.25–3.25 $ft^{-1}$, and a fourth zone adjacent said third zone having a heat transfer ratio of from about 2.75–3.75 $ft^{-1}$.

2. A rotary drum dryer, comprising:

an elongated, hollow drum having a moist product inlet and a spaced dried product outlet, with a drying chamber between the inlet and the outlet;

fighting within said drum dividing the chamber into a plurality of drying stages along the length of the chamber, including a first stage adjacent said inlet, a final stage adjacent said outlet, and at least one intermediate stage between the first and the final stages, said intermediate stage including a plurality of drying zones arranged in successive order from a point proximal to said first stage and extending towards the final stage, each of said zones configured to define a heat transfer ratio calculated by dividing the total heat-transferring surface area within the zone by the volume of the zone, one of said zones proximal to said first stage having a heat transfer ratio of from about 1.5–2.5 $ft^{-1}$, another of said zones closer to said final stage than said one zone having a heat transfer ratio from about 2.75–3.75 $ft^{-1}$, each of said zones including heat transfer fighting comprising a plurality of strut elements coupled to said drum and extending inwardly thereof, with a number of spaced apart heat transfer plates secured to corresponding strut elements.

3. The dryer of claim 2, said L-shaped members being arranged in generally circumferentially aligned and axially spaced apart rows, each of said rows being circumferentially offset relative to the adjacent row.

4. The dryer of claim 2, including strap members extending between and interconnecting the second leg members of adjacent, circumferentially spaced apart L-shaped members.

5. A rotary drum dryer, comprising:

an elongated, hollow drum having a moist product inlet and a spaced dried product outlet, with a drying chamber between the inlet and the outlet;

fighting within said drum dividing the chamber into a plurality of drying stages along the length of the chamber, including a first stage adjacent said inlet, a final stage adjacent said outlet, and at least one intermediate stage between the first and the final stages, said intermediate stage including a plurality of drying zones arranged in successive order from a point proximal to said first stage and extending towards the final stage, each of said zones configured to define a heat transfer ratio calculated by dividing the total heat-transferring surface area within the zone by the volume of the zone, one of said zones proximal to said first stage having a heat transfer ratio of from about 1.5–2.5 $ft^{-1}$, another of said zones closer to said final stage than said one zone having a heat transfer ratio from about 2.75–3.75 $ft^{-1}$, said first stage including heat transfer fighting comprising a number of circumferentially spaced apart generally L-shaped numbers secured to said drum and extending inwardly thereof, each of said L-shaped members including a first leg secured to said drum and a second leg oriented at an angle relative to said first leg.

6. A rotary drum dryer, comprising:

an elongated, hollow drum having an internal surface and a center area, said drum being provided with a moist product inlet and a spaced dried product outlet, with a drying chamber between the inlet and the outlet;

flighting within said drum dividing the chamber into a plurality of drying stages along the length of the chamber, including a first stage adjacent said inlet, a final stage adjacent said outlet, and at least one intermediate stage between the first and the final stages, said intermediate stage including a plurality of drying zones arranged in successive order from a point proximal to said first stage and extending towards the final stage, each of said zones being provided with a plurality of radially disposed, circumferentially spaced fighting members extending from the center area of the drum to said internal surface thereof, each pair of adjacent fighting members presenting a product passage therebetween, the product passages of each zone being in direct, substantially unimpeded communication with the passages of the next adjacent zone, said fighting members being configured and arranged to present a heat transfer ratio calculated by dividing the total heat-transferring surface area within the zone by the volume of the zone, one of said zones proximal to said first stage having a sufficient number of said fighting members to define a heat transfer ratio of from about 1.5–2.5 $ft^{-1}$, another of said zones closer to said final stage than said one zone having a greater number of said fighting members than the number of fighting members in said one zone and defining a heat transfer ratio from about 2.75–3.75 $ft^{-1}$.

7. The dryer of claim 6, said zones arranged in contiguous relationship along the length of said intermediate stage with the number of fighting members in respective zones progressively increasing in number in a direction from the first stage toward the final stage of the dryer.

8. The dryer of claim 7, said another zone being in contiguous relationship with said final stage.

9. The dryer of claim 6, said one zone being in contiguous relationship with said first stage, and wherein the fighting members of said another zone are circumferentially offset with respect to the fighting members of said one zone.

10. The dryer of claim 6, said final stage having a heat transfer ratio smaller than the heat transfer ratio of any of said zones.

11. The dryer of claim 6, said first stage including heat transfer flighting comprising a number of circumferentially spaced apart generally L-shaped numbers secured to said drum and extending inwardly thereof, each of said L-shaped members including a first leg secured to said drum and a second leg oriented at an angle relative to said first leg.

12. The dryer of claim 6, said inlet and said outlet being in general axial alignment with each other at respective ends of said drum.

* * * * *